United States Patent [19]

Washington et al.

[11] Patent Number: 4,757,230

[45] Date of Patent: Jul. 12, 1988

[54] DISPLAY TUBE

[75] Inventors: Derek Washington, Wallington; Daphne L. Lamport, Godstone, both of England

[73] Assignee: U.S. Philips Corporation, New York, N.Y.

[21] Appl. No.: 851,618

[22] Filed: Apr. 14, 1986

[30] Foreign Application Priority Data

Apr. 29, 1985 [GB] United Kingdom ..... 8510861

[51] Int. Cl.[4] ..... H01J 29/72; H01J 31/00

[52] U.S. Cl. ..... 313/422; 313/495; 313/497

[58] Field of Search ..... 313/422, 495, 496, 409, 313/411, 413, 414, 105 CM, 105 R, 400, 103 CM, 103 R, 497

[56] References Cited

U.S. PATENT DOCUMENTS

| | | | |
|---|---|---|---|
| 3,935,499 | 1/1976 | Oess | 313/495 |
| 3,936,697 | 2/1976 | Scott | 313/411 X |
| 4,028,582 | 6/1977 | Anderson et al. | 313/422 |
| 4,668,890 | 5/1987 | Swingler | 313/105 R |

FOREIGN PATENT DOCUMENTS

| | | | |
|---|---|---|---|
| 2127616 | 4/1984 | United Kingdom | 313/422 |

*Primary Examiner*—David K. Moore
*Assistant Examiner*—Michael Horabik
*Attorney, Agent, or Firm*—John C. Fox

[57] ABSTRACT

In a flat cathode ray display tube of the type comprising an envelope having parallel front and rear walls and containing implosion-preventing support walls dividing the envelope into a plurality of modules, each module including a thermionic wire electron emitter, a switching electrode arrangement having a plurality of apertures to define one of a plurality of electron beam paths directed towards a cathodoluminescent screen carried on the front wall, and a channel electron multiplier intermediate the switching electrode arrangement and the screen for beam current multiplication, and electrodes carried by the support walls for line scanning and electron acceleration, the switching electrode arrangement comprises a stack of mutually insulated electrodes associated with each aperture and selectively operable to allow or prevent electrons to pass therethrough thereby to effect frame scanning.

10 Claims, 3 Drawing Sheets

DISPLAY TUBE

BACKGROUND OF THE INVENTION

Figure 1:
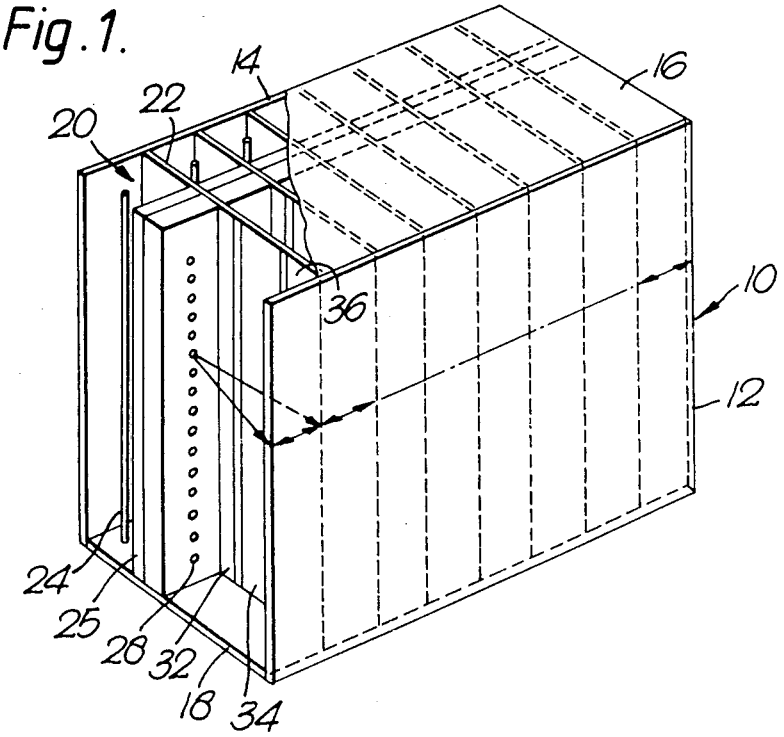

This invention relates to a display tube comprising an evacuated envelope having substantially flat, parallel spaced-apart front and rear walls and a plurality of support means dividing the interior of the envelope into a plurality of modules extending between the front and rear walls for substantially the full height of the envelope and a cathodoluminescent screen on the interior of the front wall, each module having means for producing and directing an electron beam along one of a plurality of paths extending toward the screen, an electron multiplier extending substantially transverse to said paths for amplifying the electron beam, and deflection means for deflecting the electron beam in a direction transverse to the said paths.

Such a flat panel display tube is described in published British Patent Application No. 2110465. This display tube is suitable for providing a display area of around 0.75 to $1M^2$. The interior of the tube envelope is divided into a plurality of horizontally adjacent modules by the support walls, which extend vertically and contact and support the front wall, that is the faceplate. In consequence, the faceplate can be of a thickness substantially thinner, and therefore lighter, than for a conventional cathode ray tube faceplate. In a display tube embodiment described in this published application each module has an electron gun which produces a beam of electrons and directs the beam of electrons along a first path substantially parallel to the rear wall of the envelope, and deflecting electrodes carried on the rear wall, comprising a plurality of parallel, spaced-apart electrodes extending transverse to the electron beam's first path, which are selectively operable to deflect by electrostatic forces the electron beam from that first path through substantially ninety degrees into one of a plurality of second paths extending towards the electron multiplier and the screen.

By providing an electron multiplier in each module it is possible to use a low voltage, low current beam to effect frame scanning vertically of the module, this scanning being accomplished by the deflecting electrodes on the rear wall with the beam being deflected from its first path sequentially through the plurality of second paths. This means that the beam current can be kept sufficiently low to avoid the effects of space charge blow-up of the electron beam. Also, low voltages can be used by the deflecting electrodes. Thereafter the electron beam is amplified by the electron multiplier to provide a high current beam which is accelerated towards the screen by high voltages applied via electrodes on the support means defining the margins of the module.

Line scanning, widthwise of the module, is accomplished by way of the deflection means which deflect the electron beam transversely of the plurality of paths. These deflection means are constituted by pairs of parallel electrodes which are disposed between the electron multiplier and the screen on the supports, and which for example extend substantially perpendicular to the screen and heightwise of the module.

In comparison with conventional display tubes offering similar sized display areas, the aforementioned display tube is considerably smaller both in weight and overall dimensions, particularly its depth. However, whilst the electron guns are arranged in their respective modules to direct the electron beam produced thereby substantially parallel to the rear wall of the envelope so as to allow a reduction in the depth of the display tube to some extent, sufficient space must still be provided in this region of each module to allow the electron beam to be deflected from its first path through substantially ninety degrees by the deflecting electrodes towards the electron multiplier.

A modular kind of cathode ray display tube having some similarities with the above described tube is disclosed in British Patent Specification No. 2127616. In an embodiment described in FIGS. 6 and 7 of this specification, each module is provided with a vertically arranged area emitter as a source of electrons and a planar array of discrete, vertically-spaced electrodes disposed between the area emitter and the electron multiplier each having one aperture therethrough corresponding to a line of the display to be produced. The apertures are arranged in a row and define on the side of the electrode array remote from the emitter a plurality of vertically-spaced beam paths. The electrodes are individually addressed so as to prevent or allow electrons to pass through the aperture in the electrode and by addressing the electrodes in sequence, electrons are allowed to pass through the aperture of each successive electrode in turn to produce an electron beam following only one of the plurality of paths at any one time. In this way frame scanning is achieved with the apertures determining respective lines of the display. Line scanning is accomplished by deflection electrodes located adjacent the multiplier output.

Whilst provision of the electron emitter and switching electrode arrangement in this manner enables an electron beam to be defined along the plurality of paths easily and conveniently and requires less space so that the volume of this region of the display tube, in particular the distance between the rear wall of the envelope and the electron multiplier is reduced significantly, the arrangement suffers from the disadvantage that driving the tube is made more complicated in view of the need to address each of the apertures in a module individually. For a tube having say, a 500 line display, 500 apertured electrodes will be required, each being interconnected to a switchable driving circuit.

SUMMARY OF THE INVENTION

It is an object of the present invention to provide a tube in which field scanning is accomplished more easily whilst the advantages of using a switching electrode arrangement are retained.

According to the present invention there is provided a display tube comprising an evacuated envelope having substantially flat, parallel spaced-apart front and rear walls and a plurality of support means dividing the interior of the envelope into a plurality of modules extending between the front and rear walls for substantially the full height of the envelope and a cathodoluminescent screen on the interior of the front wall, each module having means for producing and directing an electron beam along one of a plurality of paths extending toward the screen comprising an electron emitter and a switching electrode arrangement having a plurality of apertures extending in a row defining said plurality of paths, the switching electrode arrangement being operable selectively to allow electrons emitted by the electron emitter to pass through the apertures in sequence thereby causing the electron beam to be switched through said plurality of paths, an electron multiplier extending substantially transverse to said paths for amplifying the electron beam, and deflection means for deflecting the electron beam in a direction transverse to the said paths, which is characterised in that the switching electrode arrangement comprises a plurality, n, of electrode-carrying layers overlying one another with said plurality of apertures, r, extending through the electrodes thereof and the electrodes of adjacent layers being insulated electrically from one another, and in that n and r obey the relationship $2^{n-1}<r\leqq/2^{n}$.

Advantages of the arrangement according to the invention are that compared with the arrangement of British Patent Specification No. 2110465 the space-reducing use of a switching electrode arrangement is retained whilst, by providing the electrode arrangement with a plurality of electrode-carrying layers and apertures as specified, frame scanning can be implemented in an easy and less complicated manner than with the display tube described in British Patent Specification No. 2127616.

In a preferred embodiment of the invention, the layers may carry $2^{n}/2^{s-1}$electrodes or groups of interconnected electrodes where s is the number of the layer, with each electrode or group of interconnected electrodes being associated with $2^{s-1}$ apertures through the electrode arrangement, and alternate electrodes or group of electrodes of each layer are to be connected together to form two sets, each set having a respective terminal to which addressing signals are to be supplied. The order in which the layers are arranged may be varied. The alternate sets of electrodes or groups of electrodes of each electrode-carrying layer are arranged to be supplied via their terminals with opposite polarity potentials. With such an arrangement, the number of terminals needed for the switching electrode arrangement is 2n and by appropriately addressing these terminals an electron beam can be defined in turn along all the plurality of paths. Thus, for an electrode arrangement having, say, 1024 apertures defining 1024 beam paths, ten layers with twenty terminals would be required. This is a significant reduction over the number of terminals needed for the deflecting electrodes employed in, firstly, the arrangement of British Patent Specification No. 2110465, where, in order to produce a corresponding number of beam paths, possibly 35 electrodes terminals would be required, each having to be driven separately, and secondly, the arrangement of British Patent Specification No. 2127616 in which 1024 individually addressable electrodes would be required.

Conveniently, the switching electrode arrangements of all the modules of the display tube may be connected together in parallel. Thus, only 2n terminals are required to be addressed regardless of the number of modules.

The electron emitter is preferably an area emitter. More particularly, the emitter may be a linear emitter, for example, a wire thermionic emitter or a linear array of point emitters, the linear emitter being arranged to produce low current, low energy electrons over the length of the row of apertures in the switching electrode arrangement. By appropriately addressing the switching electrode arrangement, the electron beam defined by the arrangement can be moved progressively through each of the plurality of paths to achieve frame scanning with emitted electrons being allowed to pass through each aperture in turn.

The electron multiplier may comprise a plurality of channels corresponding in number with the apertures through the switching electrode arrangement, each channel being aligned substantially with a respective one of the plurality of apertures, thus providing a separate channel for each beam path.

Preferably, the row of apertures extends heightwise of the module and the deflection means comprises deflection electrodes disposed intermediate the multiplier and the screen and is arranged to deflect the electron beam substantially at right angles to the row of apertures.

The switching electrode arrangement may further include electrically conductive mesh facing the input of the multiplier and covering the plurality of apertures.

In order to provide a particularly compact and robust tube, the switching electrode arrangement and the multiplier are secured together with the output surface of the electrode arrangement disposed adjacent the input surface of the electron multiplier.

Figure 2:
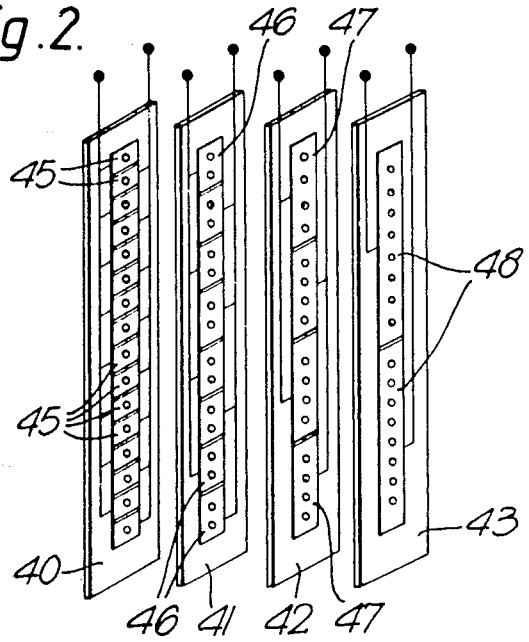
Figure 3:
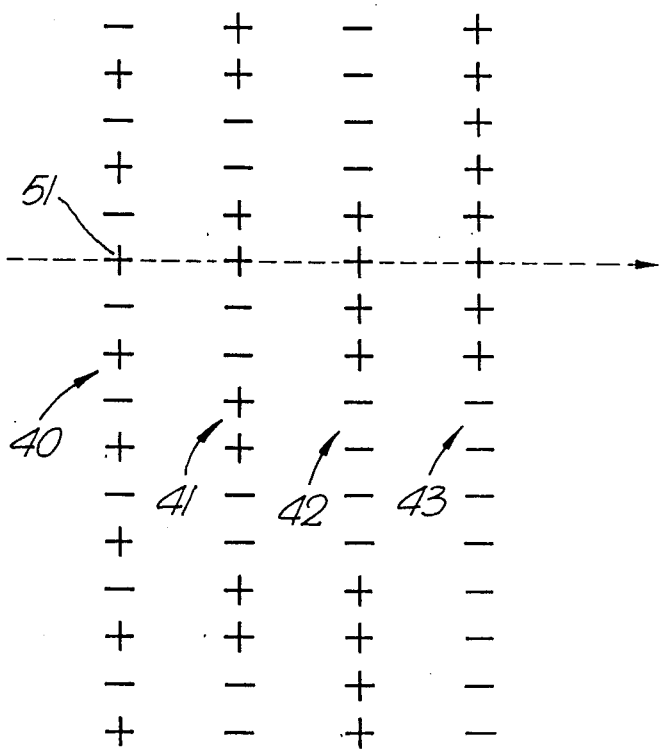
Figure 4:
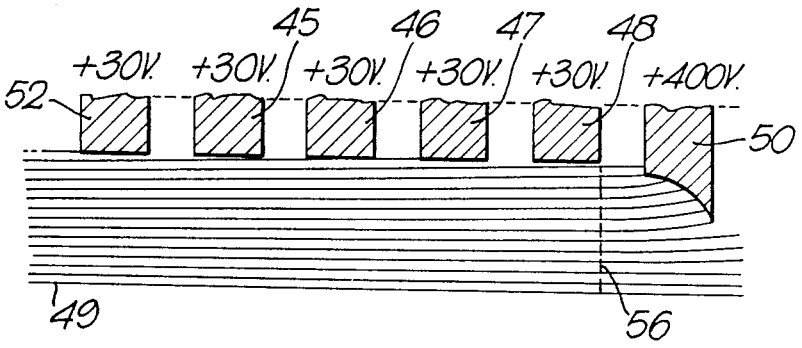
Figure 5:
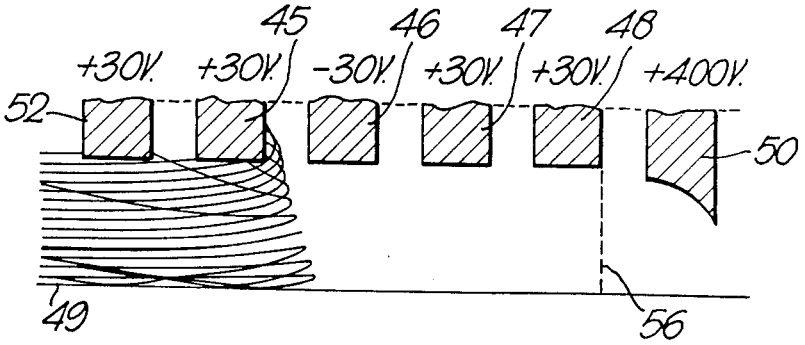

A display tube in accordance with the invention will now be described, by way of example, with reference to the accompanying drawings in which:

FIG. 1 is a schematic, perspective view, partly broken away, of the display tube according to the invention, whose parts, for simplicity, are not shown to scale, FIG. 2 is a diagrammatic, exploded perspective view of a switching electrode arrangement used in the display tube of FIG. 1, FIG. 3 illustrates typical electric potential applied to the electrode arrangement during operation thereof, and FIGS. 4 and 5 are schematical representations of one half of an aperture in the switching electrode arrangement showing electron trajectories.

Referring to FIG. 1, the display tube comprises an evacuated envelope 10 formed by an optically transparent front wall 12, a rear wall 14, top and bottom walls 16 and 18, and side walls which are not visible in the drawing. The interior of the envelope 10 is divided into a plurality of modules 20 by supporting walls 22 of electrically-insulating material which contact and support the front and rear walls 12, 14 and extend between the top and bottom walls 16, 18 and help prevent them from imploding under the pressure of ambient air which, in the case of the front wall having an area of around $1m^2$, is considerable.

A linear electron source, comprising a stretched wire thermionic emitter 24, is disposed in each module 20 and extends heightwise of the module parallel to and adjacent the rear wall 14. The emitter, which is supported at intervals along its length by posts (not shown) emits upon energisation low current, low energy electrons. In the case of the walls 14, 16, 18 being of electrically insulative material, then at least the wall 14 is metallised to prevent charges accumulating thereon.

Disposed adjacent the emitter 24 in each module 20 is a switching electrode arrangement 25 extending parallel to the rear wall 14 between adjacent supporting walls 22 and top and bottom walls 16 and 18 which serves as a barrier between the emitter 24 and the remainder of the module 20. The switching electrode arrangement 25, which will be described in greater detail hereinafter, has a series of apertures in a row extending heightwise of the envelope 10 and is operable in response to addressing signals supplied to electrodes thereof to allow electrons emitted by the emitter selectively through each of the apertures in turn, each aperture thereby serving to form an electron beam which, by the action of suitable accelerating voltages, is directed towards the front face 12, when electrons are allowed to pass therethough. Each aperture therefore defines a respective electron beam path. By appropriately addressing the electrode arrangement 25, a low current, low voltage electron beam directed towards the front face of the envelope can be switched sequentially along a plurality of spaced, parallel paths corresponding in number and spacing with the apertures in the electrode arrangement 25.

A laminated dynode channel electron multiplier 28 is situated in each module 20 at a point nearer the rear wall 14 than the front wall 12. As shown in FIG. 1, the electron multiplier comprises a single row of channels, the number and pitch spacing of the channels corresponding with the number and pitch of the apertures switching electrode arrangement 25 and determining the resolution (i.e. line number and spacing) of the image to be displayed. The function of the electron multiplier 28 is to current multiply the electron beam(s) from the switching electrode arrangement 25, the beam(s) prior to reaching the multiplier being low current, low voltage in order to minimise power consumption. The construction and operation of the electron multiplier 28 are described in detail in published British Patent Specification Nos. 1,401,969, 1,434,053 and 2,023,332A and for a further understanding reference is invited to these specifications. Briefly however, the multiplier comprises a stack of spaced-apart, barrel-shaped apertured mild steel plates held at progressively higher voltages. The apertures in the plates are aligned to form individual channels and are coated with secondary emitting material. An electron striking the wall of an aperture in the first dynode produces a number of secondary electrons, each of which is accelerated towards and impacts the wall of an aperture in the second dynode to produce more secondary electrons, and so on. The stream of electrons leaving the final dynode is accelerated towards the front wall 12 by an accelerating field established between the output of the electron multiplier 28 and post deflection acceleration electrodes adjacent the front wall 12. The wall 12 carries on its internal surface a cathodoluminescent phosphor screen which responds to electrons impinging thereon to emit light, thus forming a visible image. As previously mentioned, electrons emitted by the emitter 24 are formed into an electron beam by the switching electrode arrangement 25. By appropriate operation of the arrangement 25, the beam can be made to move progressively downwards of the module 20 through its plurality of paths from one aperture to the next, and hence from one channel to the next of the electron multiplier 28, in order to effect frame scanning, the beam being returned to the top aperture following each complete frame scan.

Line scanning of the high current electron beam emanating from the channel electron multiplier 28, that is, deflection of the beam transversely of the plurality of beam paths and over the width of its module 20 as indicated by the double-headed arrows in FIG. 1, is accomplished by means of electrodes applied to the supporting walls 22 between the electron multiplier and the front wall 12. For a television display, the scan time for a complete raster line including flyback is typically around 64 μs and accordingly by parallel addressing of the modules 20 of the display tubes each output electron beam from the multiplier 28 has 64 μs to scan the screen across its modular width and flyback. The line scanning electrodes are applied to the supporting walls 22 for example by evaporation, screen printing or sputtering.

By way of example, the front wall 12 of the envelope measures 1300 mm (long) by 700 mm (high) and the distance between the screen on the front wall 12 and the output surface of the electron multiplier around 70 mm. The module pitch is around 25 mm. The vertical pitch of the channels in the electron multiplier, and likewise the aligned apertures in the switching electrode arrangement, defines the vertical resolution of the image displayed and is thus chosen accordingly. For simplicity, only sixteen channels are shown in FIG. 1 but is should be understood that the actual number of channels employed in a typical display tube would be considerably larger, for example around 750 channels per module.

Referring to FIG. 1, three sets of vertical, line scanning electrodes 32, 34 and 36 are applied to the module walls 22 which themselves are of an electrically insulative material. Between adjacent electrodes there may be a resistive strip across which there is a progressive potential drop so that, together with the corresponding strip on the opposite wall 22, an electron lens is formed. The electrodes 32 are held at the output voltage of the electron multiplier 28 and the electrode 36 at, for example 8 kV with respect to electrodes 32 to provide the necessary accelerating field for the electron beam. The electrodes 34 are used for line scanning and accordingly the voltage applied to each is varied as required around a mean of 4 kV with respect to electrodes 32. In order to bring about a deflection to one corner of the screen portion in each module, a deflection voltage of around 1.6 kV is necessary so that one electrode 34 is at 3.2 kV and the associated opposite electrode 34 is at 4.8 kV. For a fuller description of the electrodes 32, 34 and 36, their operation and variants thereof, reference is invited to published British Patent Application No. 2110465A.

The construction and operation of the switching electrode arrangement 25 will now be described with reference to FIGS. 2, 3 and 4. The arrangement is a laminate structure comprising a number of overlying, apertured electrode-carrying layers of insulative material which are stacked together to form a rigid structure with metal electrodes on one layer being electrically insulated from those on an adjacent layer. In the particular example shown in FIG. 2, there are four layers, 40 to 43, the first layer 40 carrying sixteen individual electrodes, generally referenced 45, each having a respective aperture therein, the second layer carrying eight individual electrodes, generally referenced 46, each having two apertures therein, the third layer carrying four individual electrodes, generally referenced 47, each having four apertures therein, and the fourth layer carrying two individual electrodes, generally referenced 48, each having eight apertures therein. Alternate electrodes on each layer are electrically connected together as shown. The apertures in the electrodes align with one another and with apertures in the insulative material of the layers 40 to 43 so that in the stacked construction sixteen apertures are provided in the electrode arrangement, corresponding in number with the channels in the electron multiplier 28 and having the same pitch so as to align therewith.

FIGS. 4 and 5 are schematic cross-sectional representations through one half of one aperture of the switching electrode arrangement, the aperture's center line being referenced at 49, showing examples of electrode potentials and electron trajectories in "open" and "closed" aperture states respectively. In the example shown in FIG. 4, the electrodes associated with the aperture are all at positive potential (+30V), thereby defining an "open" aperture allowing electrons to pass therethrough, whereas in FIG. 5 the associated electrode 46 in layer 41 is at negative potential (−30V), thereby defining a "closed" aperture, the electrons being repelled by the field created at this electrode as shown and prevented from passing through the aperture.

Also shown in FIGS. 4 and 5 is the first dynode, referenced 50, of the electron multiplier 28. In this embodiment, and as shown in FIG. 1, the switching electrode arrangement 25 is secured directly to the electron multiplier 28 so that together they constitute a compact and robust integral structure. However, the switching electrode arrangement 25 may alternatively be separate from the electron multiplier 28 with its output surface physically spaced from the input surface of the multiplier. A voltage swing of around 60V is required on an electrode in the electrode arrangement in order to close the aperture, e.g. from +30V to −30V.

By suitably addressing the electrodes of the four layers with potentials relative to the emitter potential, the apertures can be selectively defined as "open" so as to allow electrons emitted by the emitter 24 to pass therethrough and "closed" so as to prevent electrons passing therethrough, thus determining which of the plurality of vertically separated paths to the electron multiplier the electron beam formed by the "open" aperture is to take. An example is illustrated in FIG. 3 where positive and negative signs are used to illustrate the sixteen apertures in each of the layer 40 to 43 in accordance with the potential of their respective electrode. Four consecutive positive apertures in the layers 40 to 43 and their associated electrodes represent an "open" aperture through the electrode arrangement, whereas any aperture in a negatively biased electrode repels electrons and is considered "closed". By switching the polarities of the eight leads from the electrodes of the four layers it is possible to create a single "open" aperture in each of the sixteen locations, one such open aperture through the arrangement being denoted 51 in FIG. 3, and to control the opening of the apertures progressively along the row of apertures in turn such that the path of the electron beam emanating from the arrangement is shifted through the plurality of possible paths to achieve frame scanning.

Whilst only sixteen apertures have been shown in FIGS. 2 and 3 in order to simplify explanation, the approach can be extended to cover an arrangement having a larger number of apertures by increasing the number of electrode-carrying layers according to the following relationship:

Maximum number of switchable apertures of the electrode arrangement $=2^n$ where n=the number of electrode-carrying layers.

More generally, where r is the number of apertures required, the relationship $2^{n-1}<r\leqq 2^n$ is obeyed. For simplicity, the actual number of apertures provided may be equal to $2^n$.

The relationship between the layers and the electrodes carried by the layers then may be summarized as follows:

Where s is the number of the electrode-carrying layer (i.e. 1 to 4 in the embodiment shown in FIG. 2) the plurality (n) of the electrode-carrying layers carry $2^n/2^{s-1}$ electrodes, or groups of interconnected electrodes (for example the electrodes 46 and 47 of layers 41 and 42 may instead comprise respectively 2 and 4 separate but interconnected electrodes each associated with an individual aperture) with each electrode or group of interconnected electrodes being associated with $2^{s-1}$ apertures. Alternate electrodes or groups of electrodes of each layer are electrically connected together to form two sets, each set having an input terminal to which addressing signals are supplied, the two sets of each electrode-carrying layer being supplied with voltages of opposite polarity.

Thus considering the sixteen aperture, four layer arrangement shown in FIG. 2, a first layer has sixteen electrodes each associated with a respective aperture with alternate electrodes connected together to form two sets, a second layer has eight electrodes each associated with two respective apertures or eight groups of two adjacent, interconnected electrodes each associated with a respective aperture, with alternate electrodes or groups of electrodes respectively being connected together to form two sets and so on.

A practical device might, for necessary vertical resolution, require for example a minimum of 750 apertures per module. As $2^9=512$ and $2^{10}=1024$, it can be seen that 10 electrode-carrying layers would be needed. For convenience, the ten layers are provided with 1024 apertures, the arrangement then obeying the above relationships with a first layer having 1024 electrodes each associated with a respective aperture, a second layer having 512 electrodes, or group of electrodes each being associated with a respective two apertures, and so on the tenth layer, with alternate electrodes or groups of electrodes of each layer being interconnected to form two sets.

In alternative arrangements, the number of apertures used need not be exactly equal to $2^n$. Considering, for example, a simple case where only fourteen apertures are required rather than sixteen as in the arrangement of FIG. 2, the switching electrode arrangement may be constructed generally as described with reference to FIG. 2 with the two uppermost apertures in each layer being either blanked off, or omitted entirely. In this case the first layer would have only fourteen operative electrodes, each associated with a respective aperture, the second layer would have only seven operative electrodes, each associated with a respective two apertures, the third layer would have three electrodes each associated with only four apertures and a fourth, uppermost, electrode associated with only two apertures, and the fourth layer would have one electrode associated with eight apertures and a second, uppermost, electrode associated with only six apertures. Naturally this approach can be extended to cover arrangements having larger numbers of apertures, for example in a ten-layer arrangement in which just 750 operative apertures are provided rather than 1024 as described above. This approach would however necessitate certain modifications to the addressing system and for this reason it is considered more desirable to make the number of operative apertures provided equal to $2^n$.

It will be appreciated that the order in which the layers are arranged is not important. With regard to FIG. 2, the layers could be arranged, for example, 42, 40, 41, 43 rather than 40, 41, 42, 43 as shown, or in any other combination. The terms 'first', 'second' etc. ascribed to the layers should therefore be construed accordingly.

Referring again to the switching electrode arrangement as depicted in FIGS. 2 and 3, electrons emitted by the emitter 24 and arriving at the input side of the arrangement will be confronted by a combination of positive and negative potentials as they arrive at the first layer 40. With regard to FIG. 3 in particular, electrons approaching the open aperture 51 will experience the action of a negative field from either side which is likely to influence detrimentally the number of electrons actually entering the open aperture. In order to eliminate this effect, a shield electrode at constant positive potential is incorporated between the electron emitter 24 and the first layer 40 of the electrode arrangement. This shield electrode is referenced at 52 in FIG. 4 (but not shown in FIGS. 2 and 3 for the sake of clarity), and conveniently can be identical to the electrode-carrying layers 40 to 43 in form except that it carries only one, continuous, electrode extending along its length.

The switching electrode arrangement 25 may be fabricated using similar materials and technologies to those used for the channel electron multiplier 28, details of which are incorporated in the published British patent specifications previously referred to. The electrodes of each layer may be supported on an insulative substrate and the interconnections between alternate electrodes formed integrally with the electrodes, or separately by laying conductive patterns on the substrates, the two sets of electrodes extending as fingers from their respective interconnecting portions and arranged interdigitated fashion. Alternatively, each set of electrodes together with its interconnections may be formed as a unitary plate-like, self-supporting, member having fingers with the two such members of each layers being again arranged in interdigitated fashion and stacked together with the members of the other layers with insulative spacing elements dispensed between adjacent layers. The apertures in the electrodes may be defined by etching using photolithographic techniques. Each electrode (or plate-like member) may have a thickness corresponding approximately to that of the first dynode of the multiplier, around 0.15 mm, and be separated from the aligned electrode on an adjacent layer by around 0.1 mm. A ten layer electrode arrangement 25 would therefore be around 2.5 mm thick. The arrangement 25 may be spaced around, for example, 4.5 mm from the electron emitter 24 which in turn is spaced around 3 mm from the rear wall 14. Typically then the distance from the rear wall 14 to the input surface of the electron multiplier 28 is around 10 mm.

Referring to FIG. 4, a fine mesh 56 is carried on the output surface of the electrode arrangement 25 and faces the electron multiplier 28. The mesh covers the exits of all the apertures. The first dynode 50 of the electron multiplier 28 is at a comparatively high potential, around 400V, in order to achieve adequate secondary emission, and the fine mesh is provided to act as a shield to prevent this high dynode potential from penetrating the apertures of the electrode arrangement. Without such a mesh, the high potential would penetrate the apertures and form an electron lens whose affect, when that aperture is "open"; would be to concentrate the electrons passing through the aperture close to the aperture axis so that they would pass through the first dynode without impinging on the secondary emission surface thereon. Instead of using a mesh, it is envisaged that the axis of the dynodes channel may be offset slightly with respect to that of the aperture in the electode arrangement to avoid this problem.

Since in a multi-module display of the kind described each module can be scanned simultaneously, the electrodes of the switching electrode arrangement 25 of one module are conveniently electrically connected in parallel with the electrodes of the electrode arrangements of the other modules, the parallel combination being addressed by a single electrode potential switching circuit. In the example shown in the drawings where the switching electrode arrangement comprises, for simplicity, only four electrode-carrying layers with sixteen apertures, the total number of connections required for frame deflection in all modules is 2 times 4 (the number of layers) plus one for the shield electrode 52, making nine altogether, irrespective of the number of modules. In a practical embodiment having 1024 apertures in the electrode arrangement, and accordingly 1024 channels in the electron multiplier giving a 1024 line display, the number of connections required for frame deflection is 2 times 10 (the number of electrode carrying layers required) plus one for the shield electrode, making twenty-one altogether. Again, therefore, the number of lines required to be driven by the electrode potential switching circuit is independent of the number of modules concerned.

Modulation of the electron beam in each module to provide picture information may be effected using a variety of alternative techniques. For example, a modulating signal may be added to the switching potentials applied to the switching electrode arrangement. Alternatively, in the embodiment in which a fine mesh (56) is disposed over the output surface of the electrode arrangement, a modulating signal may be applied to this mesh in order to obtain maximum sensitivity. In another embodiment, modulation may be applied to the electron emitter or at a grid interspersed between the emitter and the switching electrode arrangement.

By using an electron emitter in combination with a switching electrode arrangement in each module in the manner described to achieve frame scanning, a significant reduction in the volume of the region of the display tube containing those components is obtained compared with the corresponding region in the prior art display tube using an electron gun together with deflection electrodes, the distance from the rear wall to the electron multiplier being reduced, for example, by around two-thirds.

We claim:

1. A display tube comprising an evacuated envelope having substantially flat, parallel spaced-apart front and rear walls and a plurality of support means dividing the interior of the envelope into a plurality of modules extending between the front and rear walls for substantially the full height of the envelope and a cathodoluminescent screen on the interior of the front wall, each module having means for producing and directing an electron beam along one of a plurality of paths extending toward the screen comprising an electron emitter and a switching electrode arrangement having a plurality of apertures extending in a row heightwise of the envelope defining said plurality of paths, the switching electrode arrangement being operable selectively to allow electrons emitted by the electron emitter to pass through the apertures in sequence thereby causing the electron beam to be switched through said plurality of paths, an electron multiplier extending substantially transverse to said paths for amplifying the electron beam, and deflection means for deflecting the electron beam in a direction transverse to the said paths, characterised in that the switching electrode arrangement comprises a plurality, n, of electrode-carrying layers overlying one another with said plurality of apertures, r, extending through the electrodes thereof, and the electrodes of adjacent layers being insulated electrically from one another, and in that n and r obey the relationship $2^{n-1} < r \leqq /2^n$.

2. A display tube according to claim 1, characterised in that each layer of the electrode-carrying layers carries $2^n/2^{s-1}$ electrodes where s is the number of the electrode-carrying layer (1 to n), with each electrode on s electrode carrying layer being associated with $2^{s-1}$ apertures through the switching electrode arrangement, and in that alternate electrodes of each layer are electrically connected together to form two sets of interconnected electrodes, each set having a respective terminal to which addressing signals are to be supplied.

3. A display tube according to claim 2, characterised in that the two sets of interconnected electrodes of each electrode-carrying layer are arranged to be supplied via said respective terminal with opposite polarity potentials.

4. A display tube according to claim 1, 2 or 3, characterised in that the switching electrode arrangements of the plurality of modules are electrically connected together in parallel, and are adapted to be addressed simultaneously by a common control circuit.

5. A display tube according to claim 1, 2, or 3 characterised in that the switching electrode arrangement includes an apertured shield electrode arranged facing the electron emitter.

6. A display tube according to claim 1, 2 or 3 characterised in that the switching electrode arrangement further includes electrically conductive mesh arranged facing the input of the electron multiplier and overlying said plurality of apertures.

7. A display tube according to claim 1, 2 or 3, characterised in that the row of apertures extending through the switching electrode arrangement extends heightwise of the module and in that the deflection means comprises deflecting electrodes disposed intermediate the electron multiplier and the screen and arranged to deflect the electron beam substantially at right angles to the row of apertures.

8. A display tube according to claim 1, 2 or 3, characterised in that the electron emitter comprises an area emitter arranged to produce low current, low energy electrons over the length of the row of apertures extending through the switching electrode arrangement.

9. A display tube according to claim 1, 2 or 3, characterised in that the electron multiplier comprises a plurality of channels corresponding in number with said apertures through the switching electrode arrangement, with each channel thereof being substantially aligned with a respective one of said apertures.

10. A display tube according to claim 1, 2 or 3, characterised in that the switching electrode arrangement and the electron multiplier are secured together with the output surface of the electrode arrangement disposed adjacent the input surface of the electron multiplier.

* * * * *